US011236569B2

(12) United States Patent
Clemens

(10) Patent No.: US 11,236,569 B2
(45) Date of Patent: Feb. 1, 2022

(54) WELL APPARATUS WITH LATCH ASSEMBLY AND METHODS THEREOF

(71) Applicant: Halliburton Energy Services, Inc., Houston, TX (US)

(72) Inventor: Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 442 days.

(21) Appl. No.: 14/820,637

(22) Filed: Aug. 7, 2015

(65) Prior Publication Data

US 2017/0037694 A1 Feb. 9, 2017

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 33/068; E21B 23/00; E21B 23/02
See application file for complete search history.

(56) References Cited

U.S. PATENT DOCUMENTS 3,747,682 A * 7/1973 Taylor ..... E21B 23/00 166/136
4,378,839 A * 4/1983 Fisher, Jr. ..... E21B 23/02 166/217
4,558,895 A 12/1985 Tamplen
4,745,974 A * 5/1988 Higgins ..... E21B 34/105 166/125
5,040,598 A 8/1991 Pleasants
6,152,219 A 11/2000 Vick, Jr. et al.
6,719,059 B2 4/2004 Dezen et al.
6,968,902 B2 11/2005 Fenton et al.
7,051,810 B2 5/2006 Clemens et al.
7,654,329 B2 2/2010 Lindland et al.
8,028,752 B2 10/2011 Richards
8,327,943 B2 * 12/2012 Borak ..... E21B 33/037 166/368
8,714,242 B2 5/2014 Miller
8,869,899 B2 10/2014 Caulfield et al.
9,695,658 B2 * 7/2017 Hallundbæk ..... E21B 23/04
2009/0236100 A1 9/2009 Lawson
2012/0043089 A1 2/2012 Hoffman et al.
2013/0333895 A1 12/2013 Le Briere et al.
2014/0311757 A1 10/2014 Hallundbæk et al.
2017/0138140 A1 * 5/2017 Sheiretov ..... E21B 31/12
2020/0040679 A1 * 2/2020 Mauchien ..... E21B 47/09

FOREIGN PATENT DOCUMENTS

WO 06061645 6/2006
WO 10019378 2/2010

* cited by examiner

*Primary Examiner* — Nicole Coy
*Assistant Examiner* — Jonathan Malikasim
(74) *Attorney, Agent, or Firm* — Chamberlain Hrdlicka

(57) ABSTRACT

An apparatus for use with a device used in a well with a wellhead housing includes a sleeve comprising an interior profile that is configured to be coupled to the wellhead housing and an engagement assembly comprising an exterior profile that is configured to engage with the interior profile of the sleeve to prevent axial movement between the engagement assembly and the sleeve. The apparatus further includes a latch assembly coupled to the engagement assembly and configured to latch to the device.

18 Claims, 5 Drawing Sheets

WELL APPARATUS WITH LATCH ASSEMBLY AND METHODS THEREOF

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

After drilling a wellbore that intersects a subterranean hydrocarbon-bearing formation, a variety of wellbore tools may be positioned in the wellbore during completion, production, or remedial activities. For example, temporary packers may be set in the wellbore during the completion and production operating phases of the wellbore. In addition, various operating tools including flow controllers (e.g., chokes, valves, etc.) and safety devices such as safety valves may be releasably positioned in the wellbore. Such devices are generally lowered downhole by either a wireline or a working string and may be configured with a fishing neck to facilitate recovery at a later time. Once downhole, the device may be set at a desired location and released, allowing the wireline or work string to be retrieved.

The setting and retrieving of such devices may be performed mechanically by an apparatus, a work string, and/or an actuated power unit. Electrically actuated power units may receive surface power through the wireline, working string, or other conveyance after the apparatus is properly positioned. Alternatively, self-contained Downhole Power Units ("DPUs") do not require electrical power from the surface and therefore permit a wider selection of appropriate conveyances (e.g., a slickline rather than a wireline).

In either case, however, the apparatus or power unit may exert a force exceeding the strength of the slickline or wireline, particularly when trying to retrieve a device that may be stuck or subject to a significant amount of hydrostatic head resisting movement or recovery of the device.

BRIEF DESCRIPTION OF THE DRAWINGS

For a detailed description of the embodiments of the invention, reference will now be made to the accompanying drawings in which.

The illustrated figures are only exemplary and are not intended to assert or imply any limitation with regard to the environment, architecture, design, or process in which different embodiments may be implemented.

DETAILED DESCRIPTION

A system or apparatus that decreases the amount of force transmitted across the wireline, slickline, or other types of conveyance used to deploy a wellbore tool or other apparatus from a rig may provide benefits over known systems and devices.

Figure 1A:
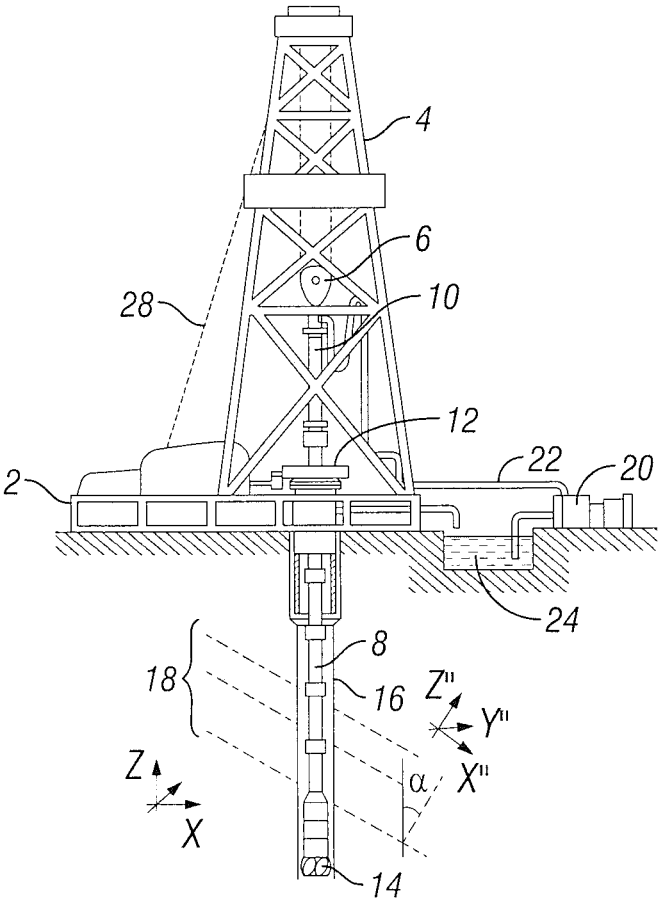
FIG. 1A shows schematic view of a wellbore environment in accordance with an embodiment of the present disclosure.
Figure 1B:
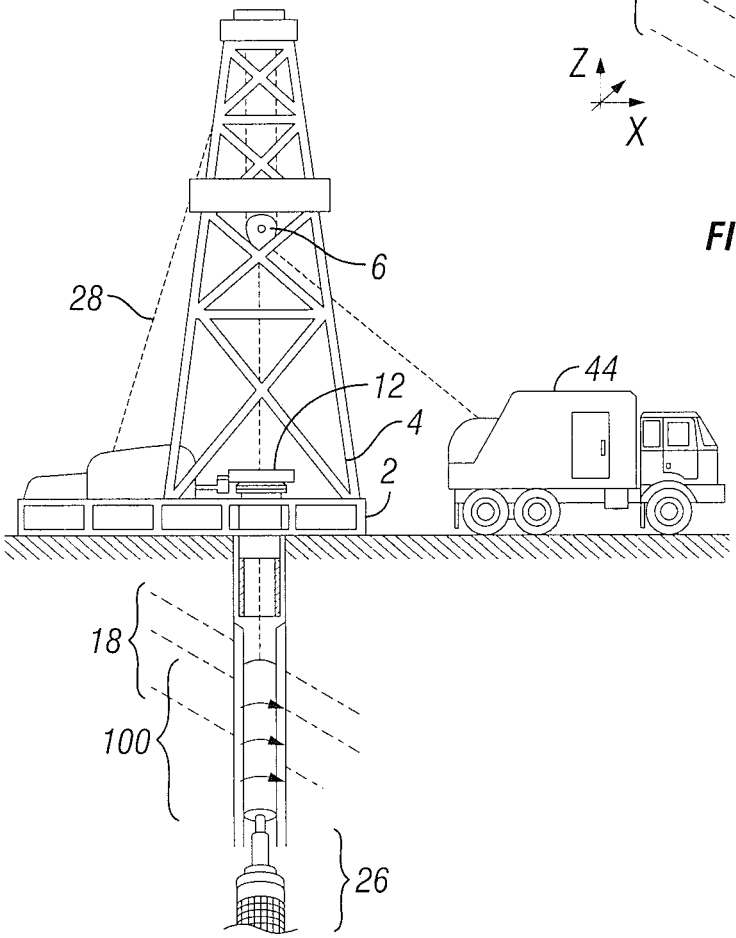
FIG. 1B shows schematic view of a linear actuator inserted into a wellbore in accordance with an embodiment of the present disclosure.

Turning now to the present figures, FIGS. 1A and 1B show a well system embodying principles of the present disclosure. The system of the present disclosure will be specifically described below such that the system is used to latch to a device used within a well, and particularly a subsea well. Nonetheless, the disclosed principles may be applied to any sort of wellbore, whether on shore or off-shore, and a person having ordinary skill in the art will understand such applications. Further, the disclosed system can be used for deploying or retrieving different types of devices, including but not limited to crown plugs, flow control devices, packers, perforating guns, safety valves, pumps, gas lift valves, anchors, bridge plugs, and sliding sleeves. Moreover, by using one or more embodiments in accordance with the present disclosure, any combination of devices may be deployed or retrieved in accordance with the discussion below.

Further, it will be understood that the present disclosure is not limited to drilling an oil well. The present disclosure also encompasses natural gas wellbores or hydrocarbon wellbores in general. Further, the present disclosure may be used for production, monitoring, or injection in relation to the recovery of hydrocarbons or other materials from the subsurface. This could also include geothermal wellbores intended to provide a source of heat energy instead of hydrocarbons.

FIG. 1A shows aspects of oil well drilling equipment used in an illustrative drilling environment. A drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As bit 14 rotates, it creates a wellbore 16 that passes through various formations 18. The wellbore 16 can be a land well or a subsea well, though shown as a land well in this environment. A pump 20 may circulate drilling fluid through a feed pipe 22 to kelly 10, downhole through the interior of drill string 8, through orifices in drill bit 14, back to the surface via the annulus between the drill string 8 and the wellbore 16 wall, and into a retention pit 24. The drilling fluid transports cuttings from the borehole into the pit 24 and aids in maintaining the borehole integrity.

At various times during the drilling process, the drill string 8 may be removed from the wellbore 16. Once the drill string has been removed, a subsurface device 26 (e.g., a plug, packer, etc.) may be coupled to an apparatus or linear actuator 100 and lowered downhole to the desired setting depth via a conveying member 28 as shown in FIG. 1B. A timer may initiate this operation. The conveying member 28 may be a slickline, wireline, coil tubing, joint tubing, braided line, and/or any other appropriate conveyance. The subsurface device 26 may be useful, for example, to seal off or isolate zones inside the wellbore 16.

Once the subsurface device 26 is positioned at the desired location within the wellbore 16, the apparatus 100 may be used to set the device 26 in place. Once the subsurface device 26 is securely set in place, the apparatus 100 may be retrieved by the operator using the conveying member 28 or any other suitable means. Alternatively, the apparatus 100 may use the conveying member 28 to retrieve the device 26. Once the apparatus 100 is conveyed to the location of the subsurface device 26 within the wellbore 16, the apparatus 100 may be used to retrieve the subsurface device 26. If power or communication from the surface is not enabled with the apparatus 100 (e.g., if the conveying member 28 does not include electrical conductors), a timer may be used to facilitate retrieval of the device 26.

Figure 2:
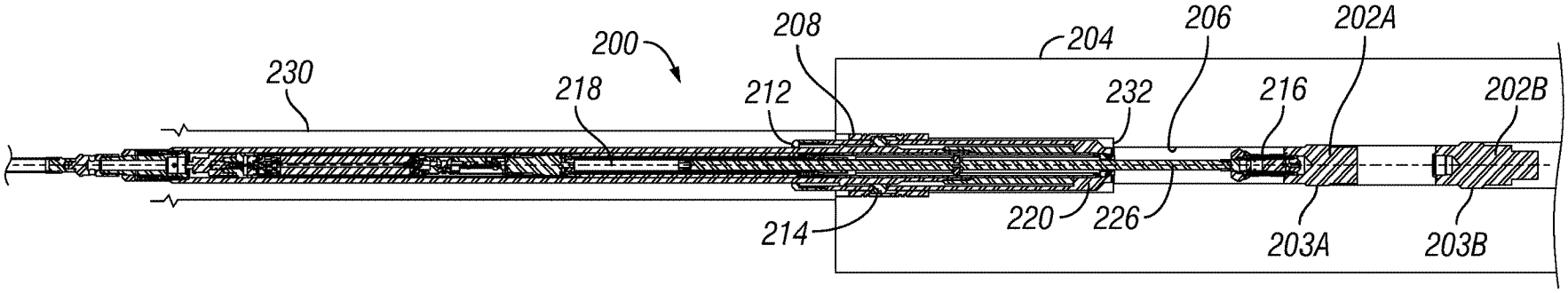
FIG. 2 shows a cross-sectional view of an apparatus for use within a system or wellbore in accordance with one or more embodiments of the present disclosure.

FIG. 2 shows a cross-sectional view of an apparatus 200 configured to deploy or retrieve one or more devices 202 for a well in accordance with one or more embodiments of the present disclosure is shown. As shown in FIG. 2, the well is a subsea well, and therefore includes a subsea wellhead 204, and the devices 202 are shown as an upper crown plug 202A and a lower crown plug 202B. The crown plugs 202A and 202B are positioned within a bore 206 of the subsea wellhead 204 in crown plug receptacles 203A and 203B and are used as a barrier to prevent fluid (e.g., seawater) or debris from entering the well through the subsea wellhead 204. The apparatus 200 in this embodiment is then used to retrieve the devices 202 from the subsea wellhead 204, such as when ready to access the well through the subsea wellhead 204 (e.g., for purposes of production or intervention for the well).

The apparatus 200 may include or be used in conjunction with a recessed interior profile. For example, and additionally shown with reference to FIG. 3, a sleeve 208 includes an interior profile 210 that is recessed into the interior surface of the sleeve 208. The sleeve 208 is shown as positioned within the bore 206 of the subsea wellhead 204, such as positioned at or adjacent the top of the subsea wellhead 204. The apparatus 200 includes an engagement assembly 212 that has an exterior profile, such as one or more keys 214, that selectively engages with the interior profile 210. When the exterior profile of the engagement assembly 212 engages with the interior profile 210, movement is prevented between the engagement assembly 212 and the sleeve 208.

The apparatus 200 also includes a latch assembly 216 that can latch to the devices 202. The latch assembly 216 is able to extend and retract from an end of the engagement assembly 212. In particular, the engagement assembly 212 includes a linear actuator 218 with the latch assembly 216 coupled to the linear actuator 218. The linear actuator 218 may include a rod 226, cylinder, or the like, to extend and retract from the linear actuator 218. In this embodiment, as the latch assembly 216 is coupled to the rod 226 of the linear actuator 218, the linear actuator 216 is able to move the latch assembly 216 with respect to the linear actuator 218 and engagement assembly 212.

Figure 3:
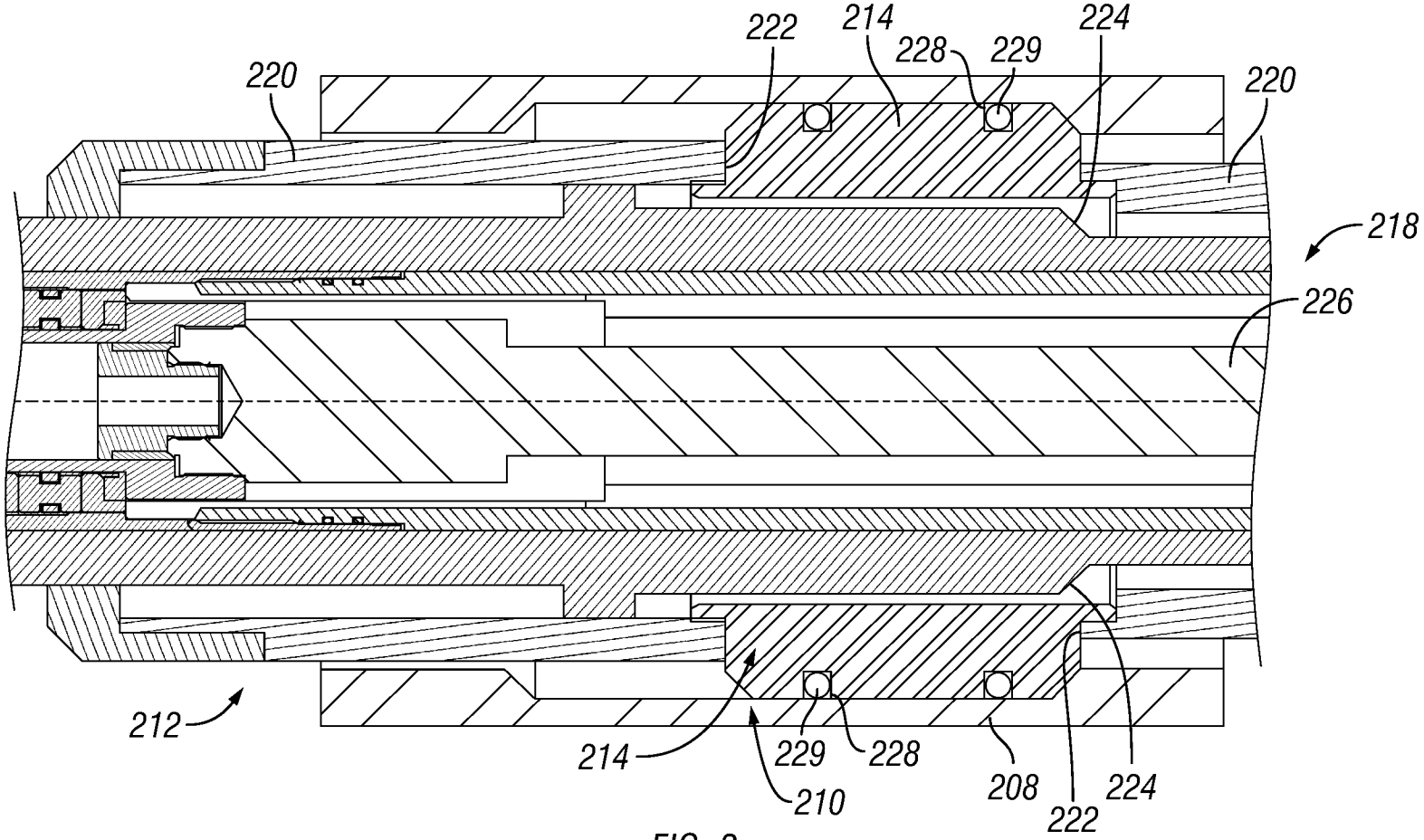
FIG. 3 shows a detailed cross-sectional view of the apparatus for use within a system or wellbore in accordance with one or more embodiments of the present disclosure.

Referring still to FIGS. 2 and 3, the engagement assembly 212 of the apparatus 200 includes an outer housing 220 with a bore formed therethrough and one or more openings 222 formed within or through a wall of the outer housing 220. In this embodiment, the linear actuator 218 is at least partially positioned within the bore of the outer housing 220. Further, the linear actuator 218 may be movable with respect to the outer housing 220 such that the linear actuator 218, and any components connected thereto, may be able to move (e.g., axially move) with respect to the outer housing 220.

As shown, the linear actuator 218 may include a tapered surface 224 (i.e., an engagement surface) formed on an exterior surface of the linear actuator 218 or coupled to the linear actuator 218. The tapered surface 224 is positioned within the bore of the outer housing 220, and the one or more keys 214 are also positioned within the bore of the outer housing 220 (e.g., between the outer housing 220 and tapered surface 224 here). The tapered surface 224 may then be used to selectively engage the keys 214 to protrude the keys 214 through the openings 222 of the outer housing 220. For example, as the linear actuator 218 and/or the tapered surface 224 move within the bore of the outer housing 220, the tapered surface 224 may engage an interior surface of the keys 214. This engagement between the tapered surface 224 and the keys 214 may then force the keys 214 radially outward to protrude through the openings 222, in which each key 214 may correspond to an opening 222. When protruding through the openings 222, the keys 214 engage the interior profile 210 of the sleeve 208, thereby preventing movement between the engagement assembly 212 (or at least the outer housing 220 of the engagement assembly 212) and the sleeve 208.

In one or more embodiments, the keys 214 may be biased radially inward, such as to facilitate engagement with the tapered surface 224. For example, a biasing member 229, such as a spring or a seal (e.g., o-ring), may be used to bias the keys 214. As shown in FIG. 3, the keys 214 may have one or more grooves 228 formed on an outer surface thereof. A biasing member 229 may be positioned within the grooves 228 to bias the keys 214 radially inward with respect to the bore of the outer housing 220 and into engagement with the tapered surface 224.

Figure 4:
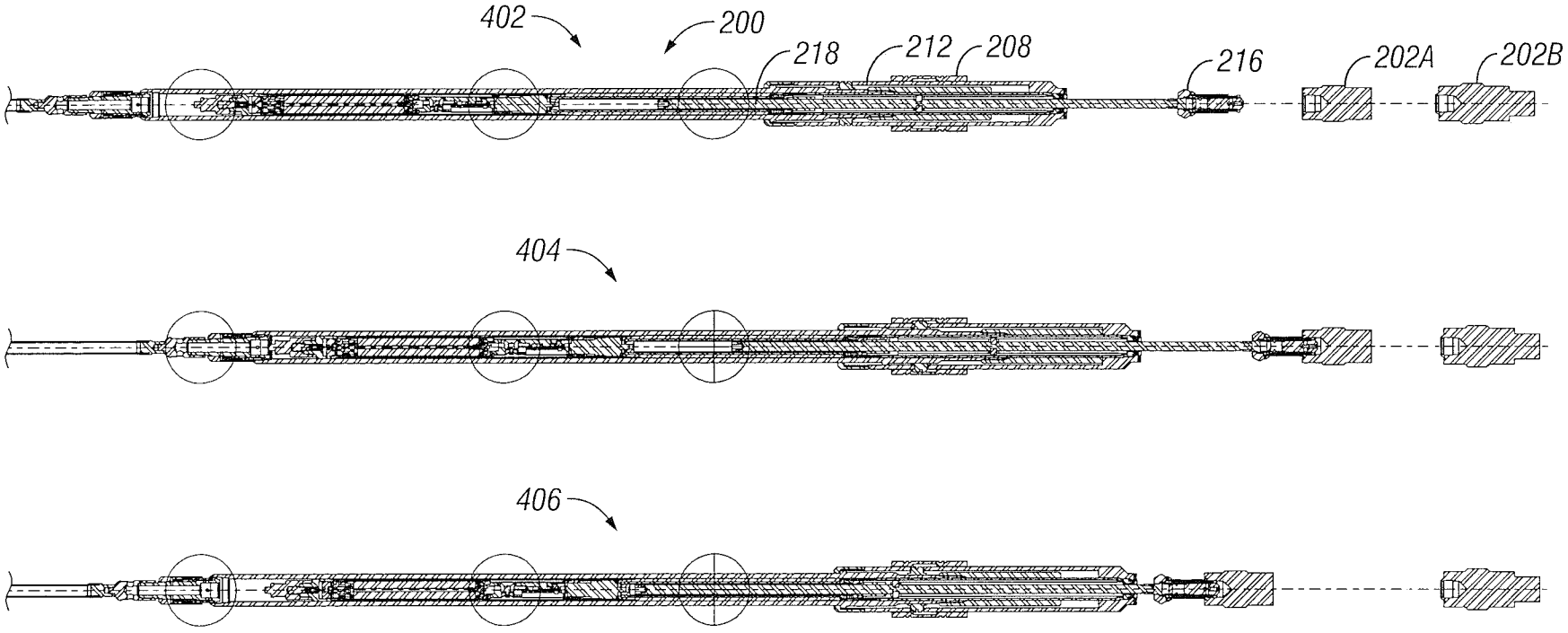
FIG. 4 shows a cross-sectional view of a sequence of an apparatus to retrieve a device for use within a system or wellbore in accordance with one or more embodiments of the present disclosure.
Figure 4:
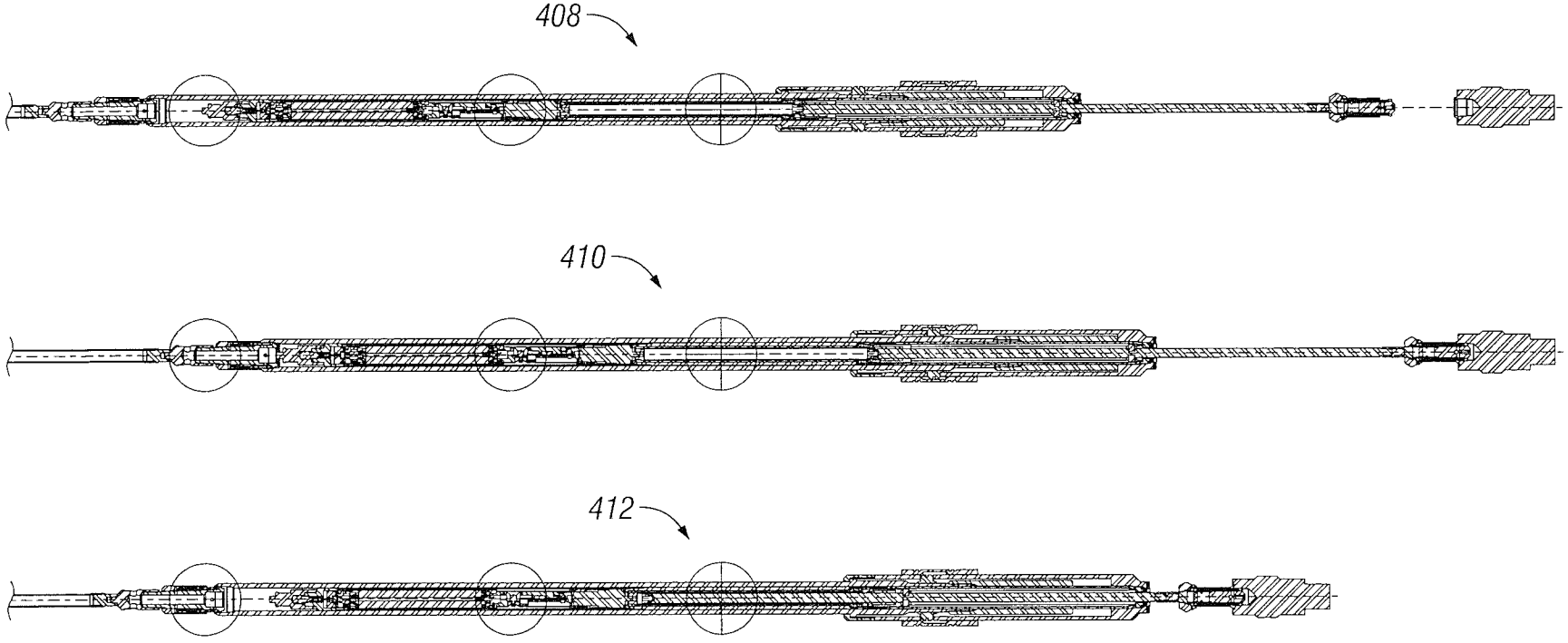

Referring additionally now to FIG. 4, a cross-sectional view of a sequence of the apparatus 200 used to retrieve one or more devices 202 in accordance with one or more embodiments of the present disclosure is shown. In this embodiment, the apparatus 200 is shown in six different stages 402-412. The apparatus 200 is coupled to a conveying member, such as a slickline, wireline, coil tubing, joint tubing, braided line, or any other type of conveying member known in the art. Further, in this embodiment, as the apparatus 200 is shown as used within a subsea well, the apparatus 200 may be deployed and lowered through a riser 230 to interact with the subsea wellhead 204. The riser 230 and subsea wellhead 204 are only shown in FIG. 2, but the devices 202 that may be positioned within the subsea wellhead 204 (e.g., upper crown plug 202A and lower crown plug 202B) are shown in the apparatus sequence in FIG. 4.

As discussed above, the sleeve 208 may be positioned within the subsea wellhead 204, or may be positioned within a component (e.g., flange) that is coupled to the subsea wellhead 204. As shown in the first stage 402, the apparatus 200 is then deployed such that the engagement assembly 212 of the apparatus 200 is introduced into and through the bore of the sleeve 208.

In the second stage 404, the apparatus 200 may be introduced into the bore 206 of the subsea wellhead 204, in which the apparatus 200 may engage a shoulder 232. In particular, the outer housing 220 may engage the shoulder 232. Alternatively, the apparatus 200 may be introduced into a component coupled to the subsea wellhead 204, in which the apparatus 200 may engage a shoulder of the component. Further, the conveying member that is deploying the apparatus 200 may allow the shoulder 232 to support at least part of the weight of the apparatus 200, or the conveying member may even apply a force to the apparatus 200 to facilitate engagement of the apparatus 200 with the shoulder 232. When the outer housing 220 then engages the shoulder 232, the linear actuator 218 and/or the tapered surface 224 moves with respect to the outer housing 220 still, thereby enabling the tapered surface 224 to engage the keys 214 to protrude the keys 214 through the openings 222 of the outer housing 220 and engage with the interior profile 210 of the sleeve 208. This engagement will prevent movement between the outer housing 220 of the engagement assembly 212, the sleeve 208, and the subsea wellhead 204. The latch assembly 216 may then also extend from the engagement assembly 212 using the linear actuator 218 to have the latch assembly 216 latch to the device 202 (e.g., upper crown plug 202A in stage 404). As communication or power may not be provided through the conveying member to control the latch assembly 216, in one or more embodiments, the latch assembly 216 may include or be operatively coupled to a timer mechanism to control the latching and unlatching of the latch assembly 216 with the device 202.

After the latch assembly 216 has latched to the device 202, the latch assembly 216 may then retract back towards the engagement assembly 212 using the linear actuator 218, as shown in the third stage 406. This may pull the device 202, the upper crown plug 202A, from the bore 206 of the subsea wellhead 204. Further, the engagement assembly 212 of the apparatus 200 anchors against the subsea wellhead 204 through the engagement with the sleeve 208 to facilitate pulling the device 202. After the device 202 has then been pulled using the latch assembly 216, the conveying member may be used to retrieve the apparatus 200. As the conveying member lifts the engagement assembly 212 of the apparatus 200, the outer housing 202 moves out of engagement (e.g., disengages) the shoulder 232 and the linear actuator 218 and/or the tapered surface 224 will move with respect to the outer housing 220. In this movement, the tapered surface 224 will then disengage the keys 214 such that the keys 214 may retract from the openings 222 of the outer housing 220 and disengage the interior profile 210 of the sleeve 208. This enables the apparatus 200 to be retracted through the riser 230 so that the device 202 may be retrieved from the apparatus 200.

In one or more embodiments, after the upper crown plug 202A has been retrieved, as shown in stages 402-406, the apparatus 200 may be used to retrieve the lower crown plug 202B. In such an embodiment, and as shown in the fourth stage 408, the apparatus 200 is deployed such that the engagement assembly 212 of the apparatus 200 is again introduced into and through the bore of the sleeve 208.

Then, in the fifth stage 410, the apparatus 200 may be introduced into the bore 206 of the subsea wellhead 204, in which the apparatus 200 may engage a shoulder 232. As discussed above, this engagement moves the linear actuator 218 and/or the tapered surface 224 with respect to the outer housing 220, thereby enabling the tapered surface 224 to engage the keys 214 to protrude the keys 214 through the openings 222 of the outer housing 220 and engage with the interior profile 210 of the sleeve 208. The latch assembly 216 then extends from the engagement assembly 212 using the linear actuator 218 to have the latch assembly 216 latch to the lower crown plug 202B.

After the latch assembly 216 has latched to the device 202, the latch assembly 216 then retracts back towards the engagement assembly 212 using the linear actuator 218, as shown in the sixth stage 412. This may pull the lower crown plug 202B from the bore 206 of the subsea wellhead 204. After the lower crown plug 202B has then been pulled using the latch assembly 216, the conveying member may be used to retrieve the apparatus 200. As with the above, when the conveying member lifts the engagement assembly 212 of the apparatus 200, the outer housing 202 moves out of engagement (e.g., disengages) the shoulder 232 and the linear actuator 218 and/or the tapered surface 224 will move with respect to the outer housing 220. In this movement, the tapered surface 224 will then disengage the keys 214 such that the keys 214 may retract from the openings 222 of the outer housing 220 and disengage the interior profile 210 of the sleeve 208. This enables the apparatus 200 to be retracted through the riser 230 so that the lower crown plug 202B may be retrieved from the apparatus 200.

As shown and discussed above, the latch assembly 216 is able to latch and unlatch to the device 202. This latching and unlatching may be facilitated through the use of a timer mechanism to control the latch assembly 216. However, in one or more embodiments, the latch assembly 216 may include a hydraulic release, such as to control the latch assembly 216 to unlatch a device when desired. For example, in one or more embodiments, when the hydraulic release of the latch assembly 216 is exposed to pressure above a predetermined amount, the pressure may activate the hydraulic release of the latch assembly 216 such that the latch assembly 216 then releases and unlatches from the device 202. In FIG. 2, pressure may be introduced through the riser 230, which may then communicate down through the apparatus 200, into the bore 206 of the subsea wellhead 204, and to the latch assembly 216. The exposure of pressure to the hydraulic release of the latch assembly 216 then activates activate the hydraulic release of the latch assembly 216 such that the latch assembly 216 releases and unlatches from the device 202.

In addition to the embodiments described above, many examples of specific combinations are within the scope of the disclosure, some of which are detailed below:

Example 1

An apparatus for use with a device used in a well with a wellhead housing, comprising:

a sleeve comprising an interior profile that is configured to be coupled to the wellhead housing;

an engagement assembly comprising an exterior profile that is configured to engage with the interior profile of the sleeve to prevent axial movement between the engagement assembly and the sleeve; and a latch assembly coupled to the engagement assembly and configured to latch to the device.

Example 2

The apparatus of Example 1, wherein the engagement assembly comprises:

an outer housing comprising a bore, a wall, and an opening formed through the wall;

a liner actuator comprising a tapered surface coupled thereto, the tapered surface positioned within the bore of the outer housing; and a key positioned between the outer housing and the tapered surface;

wherein the linear actuator is operable to engage the key with the tapered surface to protrude the key through the opening to engage the sleeve.

Example 3

The apparatus of Example 2, wherein the latch assembly is coupled to the linear actuator of the engagement assembly to move the latch assembly.

Example 4

The apparatus of Example 2, wherein the key is biased radially inward.

Example 5

The apparatus of Example 2, further comprising a biasing member configured to bias the key radially inward, wherein the biasing member comprises at least one of a spring and a seal.

Example 6

The apparatus of Example 2, further comprising more than one opening and more than one key such that each key is configured to protrude through one of the openings.

Example 7

The apparatus of Example 2, wherein the linear actuator is at least partially positioned within and movable with respect to the bore of the outer housing.

Example 8

The apparatus of Example 2, wherein the linear actuator comprises a downhole power unit that is configured to extend and retract the latch assembly from an end of the engagement assembly.

Example 9

The apparatus of Example 2, wherein the exterior profile comprises the key.

Example 10

The apparatus of Example 1, wherein the device comprises a plug that is configured to be positioned within the wellhead housing.

Example 11

The apparatus of Example 10, wherein the plug comprises an upper crown plug and a lower crown plug that are both configured to be positioned within the wellhead housing.

Example 12

The apparatus of Example 1, for use with a subsea well with a riser, wherein the apparatus is configured to be coupled to a conveying member and lowered through the riser.

Example 13

The apparatus of Example 1, wherein the latch assembly comprises a timer mechanism to control the latching and unlatching of the latch assembly with the device.

Example 14

A method to latch an engagement assembly to a device used within a well with a wellhead housing, the method comprising:

engaging an exterior profile of the engagement assembly with an interior profile of a sleeve coupled to the wellhead housing to prevent axial movement between the engagement assembly and the sleeve; and latching a latch assembly coupled to the engagement assembly to the device used within the well.

Example 15

The method of Example 14, further comprising positioning the sleeve within a bore of the wellhead housing.

Example 16

The method of Example 14, wherein:

the exterior profile of the engagement assembly comprises a key; and the engaging the exterior profile comprises protruding the key through an opening of an outer housing to engage the key with the with the interior profile of the sleeve to prevent axial movement between the engagement assembly and the sleeve.

Example 17

The method of Example 16, wherein:

the engagement assembly comprises a tapered surface positioned within the bore of the outer housing; and protruding the key through the opening comprises moving a tapered surface within the bore of the housing to engage the key and protrude the key through the opening.

Example 18

The method of Example 17, further comprising biasing the key radially inward into engagement with the tapered surface.

Example 19

The method of Example 14, further comprising extending the latch assembly from an end of the engagement assembly with a linear actuator.

Example 20

An apparatus for use with a device in a well, comprising:

a sleeve comprising an interior profile that is configured to be positioned within a wellhead housing;

an engagement assembly comprising:

- an outer housing comprising a bore and a plurality of openings formed through a wall of the outer housing;
- a liner actuator comprising a tapered surface coupled thereto, the tapered surface positioned within the bore of the outer housing; and
- a plurality of keys, each key configured to protrude through one of the openings to engage with the interior profile of the sleeve and prevent axial movement between the engagement assembly and the sleeve; and a latch assembly coupled to a linear actuator of the engagement assembly and configured to extend and retract from an end of the engagement assembly to latch to the device used within the well.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A system for use with a device used in a well, the device including a shoulder and a sleeve comprising a recessed interior profile and the device being located at a fixed location near the surface of or deeper within the well, the system comprising:

an engagement assembly comprising a protrudable exterior profile that is configured to engage with the recessed interior profile of the sleeve to prevent axial movement between the engagement assembly and the sleeve, the engagement assembly further comprising:

an outer housing; and a linear actuator comprising a tapered surface positioned within and moveable relative to the outer housing; and a latch assembly coupled to and moveable by the operation of the linear actuator and configured to latch to the device;

wherein engagement by the outer housing with the shoulder prevents further movement of the outer housing, and further movement of the tapered surface of the linear actuator within the outer housing protrudes the protrudable exterior profile into engagement with the recessed interior profile.

2. The system of claim 1, wherein the engagement assembly comprises:

the outer housing further comprising a wall and an opening formed through the wall; and the protrudable profile comprises a key positioned between the outer housing and the tapered surface;

wherein the linear actuator is moveable to engage the key with the tapered surface to protrude the key through the opening to engage the recessed interior profile.

3. The system of claim 2, wherein the key is biased radially inward.

4. The system of claim 2, further comprising a biasing member configured to bias the key radially inward, wherein the biasing member comprises at least one of a spring or a seal.

5. The system of claim 2, further comprising more than one opening and more than one key such that each key is configured to protrude through one of the openings.

6. The system of claim 1, wherein the device comprises a plug that is configured to be positioned within a wellhead housing.

7. The system of claim 6, wherein the plug comprises an upper crown plug and a lower crown plug that are both configured to be positioned within the wellhead housing.

8. The system of claim 1, for use with a subsea well with a riser, wherein the apparatus is configured to be coupled to a conveying member and lowered through the riser.

9. The system of claim 1, wherein the sleeve is located within a wellhead housing above a crown plug.

10. The system of claim 1, wherein the sleeve is located downhole within the well.

11. A method to latch an engagement assembly to a device used within a well with a wellhead housing at or near the surface of the well, comprising:

engaging the engagement assembly with a recessed interior profile recessed into an interior surface of a sleeve located within the wellhead housing above a crown plug receptacle to prevent axial movement between the engagement assembly and the sleeve by protruding a key of the engagement assembly out of an outer housing of the engagement assembly and into engagement with the recessed interior profile;

latching a latch assembly coupled to a linear actuator of the engagement assembly to the device used within the well; and wherein protruding the key comprises moving a tapered surface of the linear actuator within the outer housing to engage and protrude the key.

12. The method of claim 11, further comprising positioning the sleeve within the wellhead housing above a crown plug.

13. The method of claim 11, wherein engaging the engagement assembly comprises protruding the key through an opening of the outer housing to engage the key with the recessed interior profile of the sleeve to prevent axial movement between the engagement assembly and the sleeve.

14. The method of claim 11, further comprising extending the latch assembly from the engagement assembly with the linear actuator.

15. The method of claim 11, further comprising positioning the sleeve within the wellhead housing.

16. A system for use with a device in a well, the device including a shoulder and a sleeve comprising a recessed interior profile and the device being located at a fixed location near the surface of or deeper within the well, the system comprising:

an engagement assembly comprising:

an outer housing comprising a bore and a plurality of openings formed through a wall of the outer housing;

a linear actuator comprising a tapered surface positioned within the outer housing; and a plurality of keys, each key configured to protrude through one of the openings to engage with the recessed interior profile of the sleeve and prevent axial movement between the engagement assembly and the sleeve;

wherein engagement by the outer housing with the shoulder prevents further movement of the outer housing, and further movement of the tapered surface within the outer housing protrudes the keys into engagement with the recessed interior profile; and a latch assembly coupled to and moveable by operation of the linear actuator and configured to extend and retract from an end of the engagement assembly to latch to the device.

17. The system of claim 16, wherein the sleeve is located within a wellhead housing above a crown plug.

18. The system of claim 16, wherein the sleeve is located downhole within the well.

* * * * *